US010603682B1

(12) United States Patent
Zalucki

(10) Patent No.: US 10,603,682 B1
(45) Date of Patent: Mar. 31, 2020

(54) DEVICE THAT ASSISTS IN LUBRICATING INSTALLED DOOR HINGES

(71) Applicant: George Zalucki, Estero, FL (US)

(72) Inventor: George Zalucki, Estero, FL (US)

( * ) Notice: Subject to any disclaimer, the term of this patent is extended or adjusted under 35 U.S.C. 154(b) by 0 days.

(21) Appl. No.: 16/232,048

(22) Filed: Dec. 26, 2018

Related U.S. Application Data

(60) Provisional application No. 62/728,120, filed on Sep. 7, 2018.

(51) Int. Cl.

| | |
|---|---|
| ***B05B 12/34*** | (2018.01) |
| ***E05D 11/02*** | (2006.01) |
| ***B05B 12/20*** | (2018.01) |
| ***E05D 11/00*** | (2006.01) |
| ***B05C 21/00*** | (2006.01) |

(52) U.S. Cl.
CPC ..... *B05B 12/34* (2018.02); *B05B 12/20* (2018.02); *B05C 21/005* (2013.01); *E05D 11/0054* (2013.01); *E05D 11/02* (2013.01); *Y10S 16/02* (2013.01)

(58) Field of Classification Search
CPC ..... B05C 21/005; B05B 12/34; B05B 12/20; E05D 11/02; E05D 11/0054; Y10S 16/02; Y10T 16/5335; E05Y 2900/132
USPC ..... D8/14; 118/301, 504, 505
See application file for complete search history.

(56) References Cited

U.S. PATENT DOCUMENTS

| | | | | |
|---|---|---|---|---|
| 4,802,259 | A * | 2/1989 | Geslewitz | E05D 11/0054 16/251 |
| 5,224,240 | A * | 7/1993 | Smith | E05D 11/0054 16/251 |
| 6,165,269 | A * | 12/2000 | Kathe | B05B 12/20 118/505 |
| 6,735,821 | B1 * | 5/2004 | Christman, Jr. | E05D 11/0054 16/250 |
| 2016/0326788 | A1 * | 11/2016 | Powell | E05F 5/02 |

* cited by examiner

*Primary Examiner* — Laura Edwards
(74) *Attorney, Agent, or Firm* — Williams Intellectual Property; Benjamin F. Williams

(57) ABSTRACT

A device that assists in lubricating installed door hinges is disclosed. This invention isolates aerosol propelled lubricant to the specific area of an installed door hinge while preventing overspray and containing the lubricating liquid within the device.

2 Claims, 4 Drawing Sheets

DEVICE THAT ASSISTS IN LUBRICATING INSTALLED DOOR HINGES

RELATED APPLICATIONS

This application claims the benefit of U.S. Provisional Application Ser. No. 62/728,120, filed on Sep. 7, 2018.

BACKGROUND OF THE INVENTION

Problem Solved

Allows lubrication to target an installed door hinge by isolating the lubricating spray stream while eliminating lubricating overspray from the surrounding door jam.

Without the use of a lubricating hinge shield (device), aerosol propelled lubricants will not target the hinge effectively, resulting in lubricant overspray to the surrounding door jam.

This invention isolates aerosol propelled lubricant to the specific area of an installed door hinge while preventing overspray and containing the lubricating liquid within the device.

DETAILED DESCRIPTION OF THE INVENTION

As stated above, allows lubrication to target an installed door hinge by isolating the lubricating spray stream while eliminating lubricating overspray from the surrounding door jam. The invention claimed here solves this problem.

The device slides over and surrounds an installed door hinge. It encapsulates the hinge and isolates the lubricating spray to the targeted hinge and within the device, eliminating overspray.

The claimed invention differs from what currently exists. There is no similar invention to date. This device effectively lubricates squeaky door hinges without removing the hinge pin. It prevents and isolates overspray created by aerosol propelled lubricants.

This invention is an improvement on what currently exists. There is no similar invention to date. This device effectively lubricates squeaky door hinges without removing the hinge pin. It prevents and isolates overspray created by aerosol propelled lubricants.

Without the use of this device, lubricating installed door hinges is cumbersome, time consuming, less effective, and messy.

This invention isolates aerosol propelled lubricant to the specific area of an installed door hinge while preventing overspray and containing the lubricating liquid within the device.

DRAWING FIGURE DESCRIPTION

Figure 1:
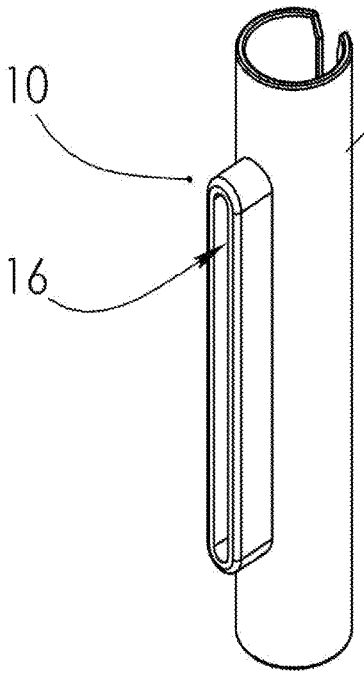

FIG. 1: is a front perspective view of the invention.

Figure 2:
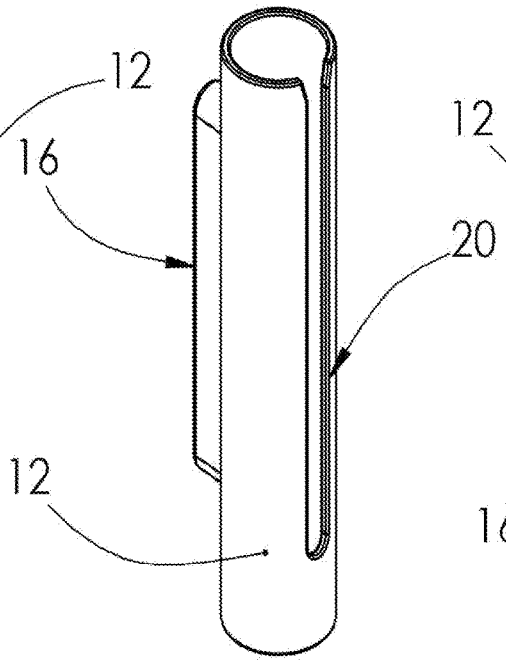

FIG. 2: is a rear perspective view of the invention.

Figure 3:
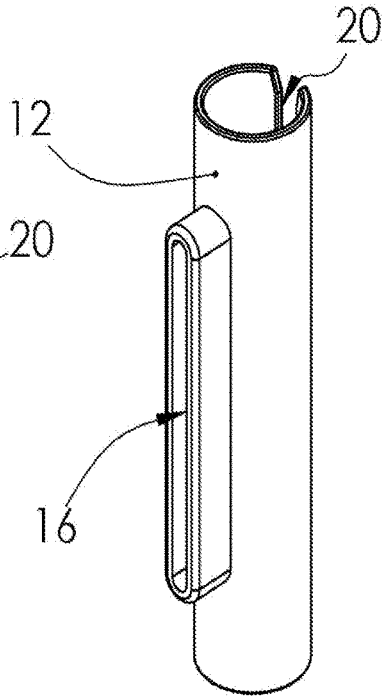

FIG. 3: is an exploded perspective view of the invention.

Figure 6:
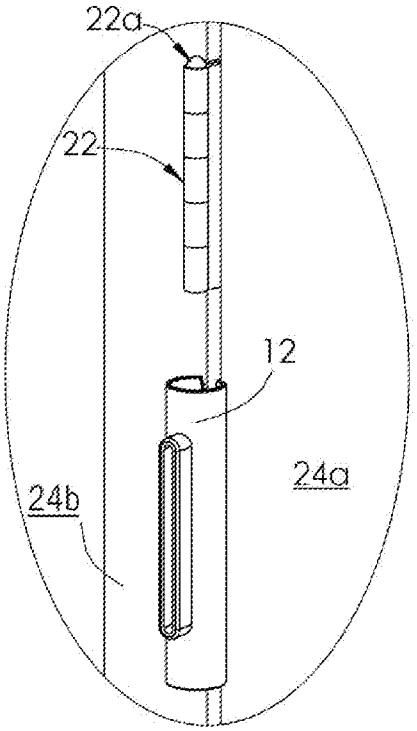
Figure 5:
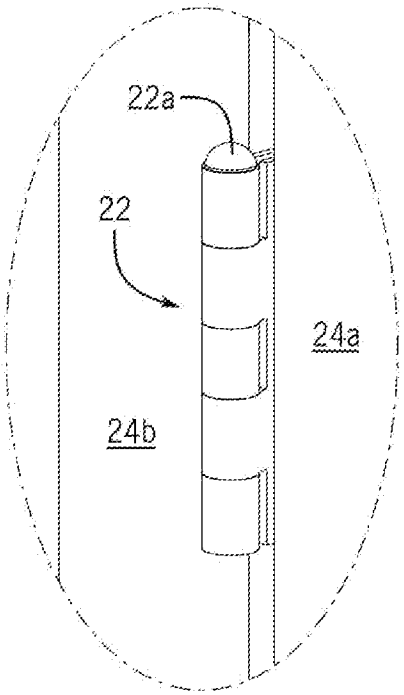
Figure 4:
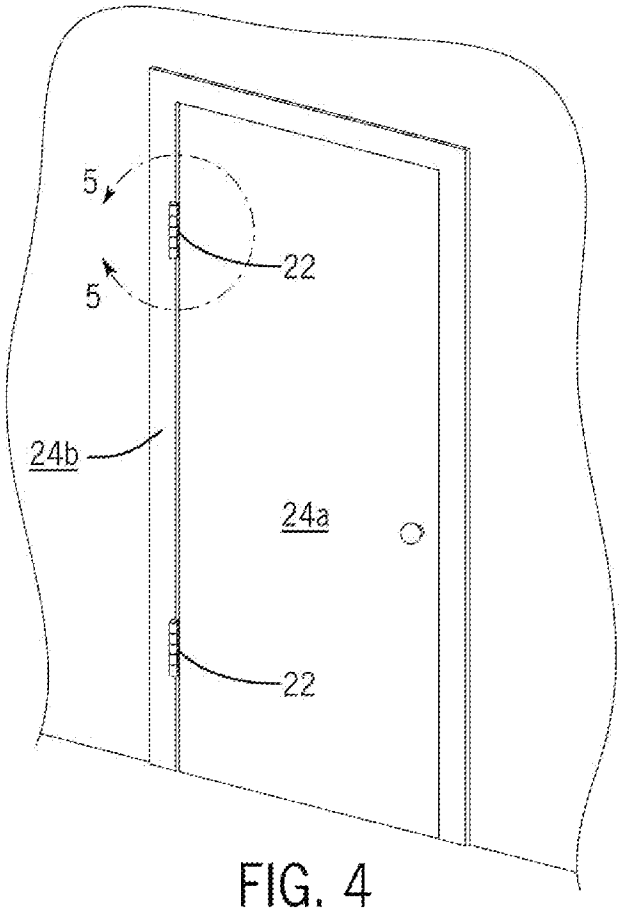

FIGS. 4-6: show the steps of installing the invention.

Figure 7:
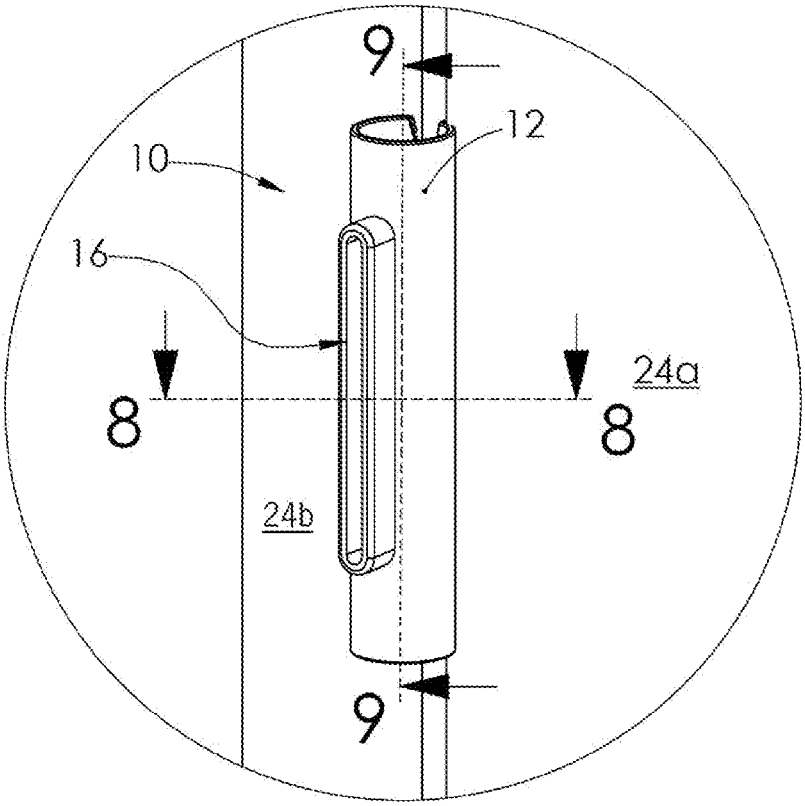

FIG. 7: shows the invention installed.

Figure 8:
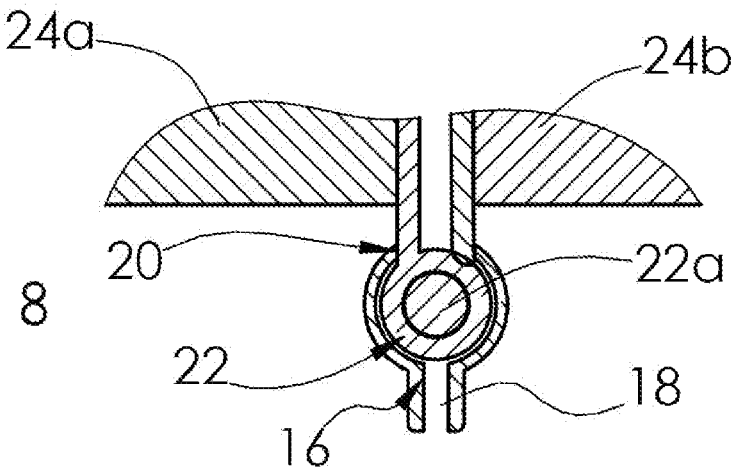

FIG. 8: is a cross-sectional view taken on line 8-8 of FIG. 7.

Figure 9:
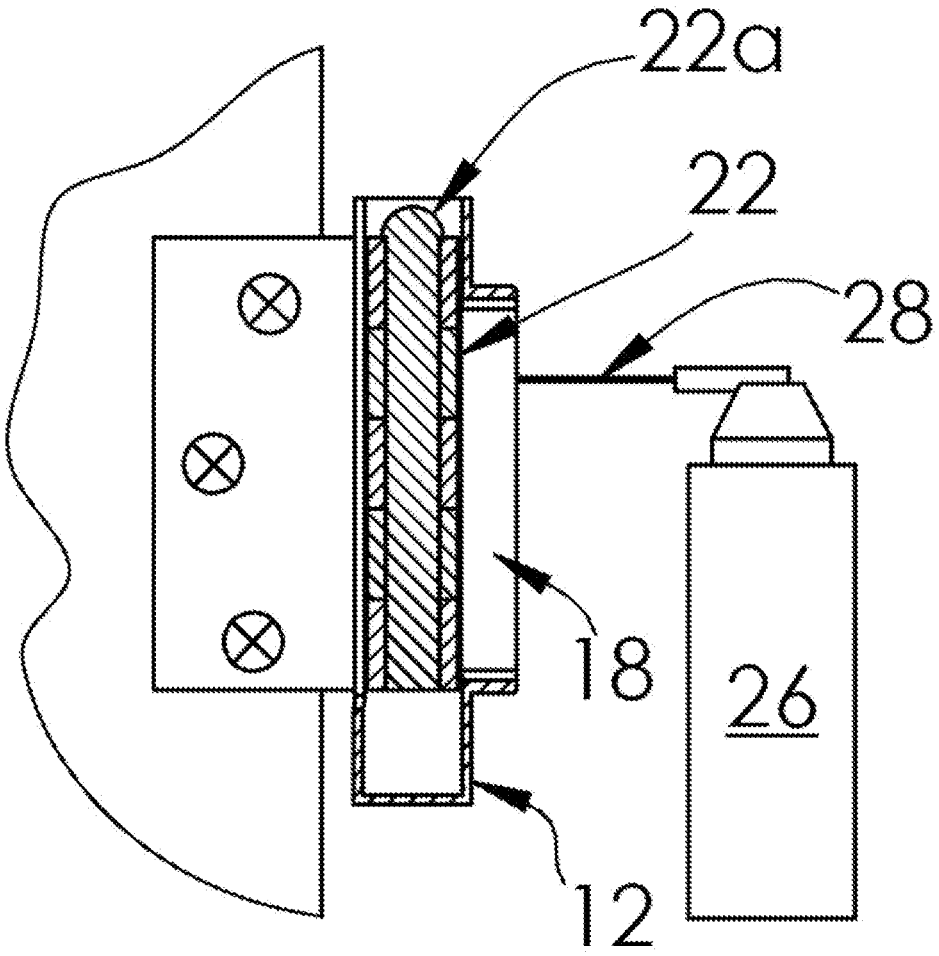

FIG. 9: is a cross-sectional view, with parts shown in full, taken on line 9-9 of FIG. 7.

ITEMIZED PARTS LIST

10: is the overall lubrication device for installed hinges invention.

12: is the hinge encasement tube.

16: is the spray nozzle guide slot or channel.

18: is the spray nozzle guide.

20: is the hinge clearance opening.

22: is the hinge.

22*a*: is the hinge pin.

24*a*: is the door.

24*b*: is the jamb.

26: is the aerosol lubricant dispenser.

28: is the aerosol lubricant nozzle.

The Version of the Invention Discussed Here Includes:

1. Hinge encasement tube (shield)

2. Spray nozzle guide

3. Hinge channel

Relationship Between the Components:

The hinge encasement tube (shield) (1) is installed around the door hinge by way of the hinge channel (3). The spray nozzle guide (2) allows a spray lubricant nozzle to travel the length of the door hinge while spray lubricant is being applied.

How the Invention Works:

The hinge shield (device) is slid over an installed door hinge from the bottom of the hinge, moving upward, by way of the hinge channel. Once the hinge shield covers the length of the door hinge, a lubricating aerosol nozzle/tube is inserted into the spray nozzle guide. Once inserted, the lubrication is sprayed directly on the hinge and contained within the encasement tube (shield) while moving the spray nozzle up, or down, the spray nozzle guide, applying lubricant to the length of the door hinge.

How to Make the Invention:

The component can be produced out of plastic resin or similar material.

How to Use the Invention:

To use this invention, one need simply to slide the device over an installed door hinge, insert a lubricating spray nozzle/tube into the spray nozzle guide, then activate the spray lubricant while moving the spray nozzle up or down the spray nozzle guide, applying lubricant to the length of the door hinge while containing the overspray within the hinge encasement tube (shield). After application slide the device down and away from the hinge and remove excess lubricating liquid held within the device (tube/shield).

The invention claimed is:

1. A device for lubricating an installed door hinge and protecting a surrounding surface from lubricant overspray, said device comprising:

a hinge encasement member defining a shield configured to slidably install around the said door hinge, said hinge encasement member comprising:

a vertically extending hinge channel disposed a substantial length of the hinge encasement member, said hinge channel configured to slide over and surround the door hinge so as to encapsulate the door hinge within the hinge encasement member; and a vertically extending spray nozzle guide slot disposed opposite the hinge channel, said spray nozzle guide slot configured to accommodate a spray lubricant nozzle inserted therein along a length of the door hinge;

wherein spray lubricant is applicable to the door hinge and the surrounding surface is shielded from lubricant overspray and wherein excess lubricant is captured and maintained within a lower portion of the hinge encasement member.

2. A device for lubricating an installed door hinge while protecting a surrounding surface from lubricant overspray, said device comprising:

a hinge shield configured to be slidably installed approximal a door hinge, said hinge shield comprising:

a vertically extending hinge channel disposed a substantial length of the hinge shield, said vertically extending hinge channel configured to engage around the door hinge and position the hinge shield to protect the surrounding surface; and a vertically extending spray nozzle guide slot disposed in the hinge shield to direct and contain lubricant sprayed therein applied to the door hinge;

wherein spray lubricant is applicable to the door hinge, the surrounding surface is shielded from lubricant overspray, and excess lubricant is captured and maintained within a lower portion of the hinge shield.

* * * * *